United States Patent [19]

Kokrhanek

[11] Patent Number: 4,542,691

[45] Date of Patent: Sep. 24, 1985

[54] METHOD AND APPARATUS FOR DECORATING ARTICLES UTILIZING HOT STAMPING PRESSES

[75] Inventor: Vladimiro Kokrhanek, Vigevano, Italy

[73] Assignee: Industria & Moda di A. Pesek, Vigevano, Italy

[21] Appl. No.: 584,536

[22] Filed: Feb. 28, 1984

[30] Foreign Application Priority Data

Mar. 2, 1983 [IT] Italy ..... 19867 A/83

[51] Int. Cl.[4] ..... B41F 15/00; B44C 1/14

[52] U.S. Cl. ..... 101/114; 101/27; 101/129

[58] Field of Search ..... 101/114, 125, 126, 124, 101/129, 8, 9, 21, 25, 27, 31

[56] References Cited

U.S. PATENT DOCUMENTS

| | | | |
|---|---|---|---|
| 922,759 | 5/1909 | Fell | 101/129 X |
| 1,847,574 | 3/1932 | Sigel | 101/129 X |
| 2,054,435 | 9/1936 | McQuiston et al. | 101/126 X |
| 2,641,178 | 6/1953 | Wendt et al. | 101/9 |
| 2,722,038 | 11/1955 | Freund | 101/31 X |
| 3,366,042 | 1/1968 | Birch | 101/27 |
| 3,584,572 | 6/1971 | Apicella | 101/25 X |
| 3,868,214 | 2/1975 | Shackleton | 101/129 X |

OTHER PUBLICATIONS

Advertisement-Kurz Roll-On-Machine RT21, RT 21/S, RT 21/SL.

Advertisement-Kurz Roll-On-Machine RT 23.

Advertisement-Kurz-The Complete Hot Stamping Machine Program.

Advertisement-Kurz Dry-Transfer-Finish.

*Primary Examiner*—Clifford D. Crowder

*Attorney, Agent, or Firm*—Amster, Rothstein & Engelberg

[57] ABSTRACT

In a method of stamping by means of hot stamping presses decorations on articles of various types, there is placed in contact with the surface of the article to be decorated a matrix comprising a plate with perforations producing the decorative design to be made on the surface of the article to be decorated. On the surface of the matrix opposite that in contact with the article there is disposed a hot stamping foil. A patrix preferably consisting of a plate of resilient deformable material is used to bring by means of the operation of the hot stamping press, the hot stamping foil into contact with the surface of the article to be decorated through the perforations of the matrix. The patrix can also comprise of a plate of any material having raised areas, either of the same material as the plate or of a different material, adapted to penetrate the perforations of the matrix. Apparatus for carrying out the inventive method comprises a matrix comprising a plate with perforations reproducing the decorative design to be made on the surface of an article, a hot stamping foil and a patrix comprising a plate of resilient deformable material or a plate bearing raised areas.

9 Claims, 8 Drawing Figures

METHOD AND APPARATUS FOR DECORATING ARTICLES UTILIZING HOT STAMPING PRESSES

The present invention relates to a method of stamping by means of hot stamping presses decorations on articles of various types and to apparatus for carrying out said method.

At present decoration by means of hot stamping presses of articles of various types is achieved by using a printing plate whose raised areas have the shape of the design to be made on the article. The prior art method comprises essentially the steps of heating said printing plate and pressing it on the surface of the article to be decorated, a hot stamping foil of a type well known in the art being interposed between the printing plate and the article. In this way the colored thermoadhesive layer of the foil is reproduced on the surface of the article.

This prior art method can be carried out by means of a vertical hot plane press or a hot roller press, both of a known type.

The prior art method has the disadvantage that it is considerably expensive especially because it requires a metal or silicone rubber printing plate which is very expensive if it is large and rather complex. In addition, if the article to be decorated does not have a perfectly smooth surface but has, as is the case of wood, pores and is rough, the prior art method has the further disadvantage that it is impossible to obtain a design with a sharp profile. In fact, the printing plate, if it has a considerable size, cannot cause the color to penetrate the pores and roughness of the wood in some part of the design without penetrating the wood too deeply in other parts of the design.

The present invention provides a method and apparatus for stamping by means of a hot stamping press decorations on articles of various types at costs considerably lower than those of the prior art method and fixtures.

By means of the method and apparatus according to the invention, it is in addition possible to obtain a design with a sharp profile even if the article is not perfectly smooth.

More particularly the method of stamping by means of hot stamping presses decorations on articles of various types is characterized by the steps of placing in contact with the surface of the article to be decorated a matrix formed by a plate with perforations reproducing the decorative design to be made on the surface of the article to be decorated, disposing on the surface of the matrix opposite that in contact with the article a hot stamping foil known per se, with the adhesive colored layer facing the matrix, and using at least a patrix adapted to penetrate the perforations of the matrix to bring by the operation of the hot stamping press the hot stamping foil in contact with the surface of the article to be decorated at the perforations of the matrix.

According to a feature of the present invention, where the article to be decorated is a stiff body, the patrix is disposed between the upper stamping member (upper hot plane or hot roller) of the hot stamping press and the hot stamping foil. Therefore, when the press is operated, the patrix pushes the foil into the perforations of the matrix and causes said foil to adhere to the article surface to be decorated in the areas of the perforations of the matrix and to transfer the colored layer of the foil to the article to be stamped.

According to another feature of the invention, where the article to be decorated is a deformable body, the patrix can be disposed between the article and the lower stamping member (stationary plane or counter-roll) of the press. Therefore, by operating the press, the patrix pushes the article to be decorated into the perforations of the matrix and causes the article surface to be decorated to adhere to the surface of the foil in the areas of the perforations of the matrix so that the foil transfers the colored layer to the article to be stamped.

This method with a patrix disposed between the article and the stationary plane or counter-roll of the press is suitably used to decorate deformable materials which maintain the deformation also after the effect of the press is discontinued so as to obtain articles with raised decorations. If said deformable materials do not maintain this deformation, the final decorative result obtained is the same as in the case of stiff articles.

The patrix will preferably consist of a deformable resilient material plate, in which case, when the press is operated, the patrix becomes deformed and penetrates the perforations of the matrix pushing the hot stamping foil into them and causing it to adhere to the article to be stamped in the areas of the perforations of the matrix so as to transfer the colored layer of the foil to the article to be stamped.

However, the patrix can be also formed by elastically non-deformable material, for example cardboard, metal or plastic and carry raised areas corresponding to the perforations of the matrix so as to penetrate them and push the hot stamping foil into them as in the case of the patrix of deformable material.

According to a further feature of the invention, for decorating a deformable article, two patrixes can be provided, one of which is disposed between the hot plane or roller of the press and the hot stamping foil and the other between the article to be decorated and the lower stationary plane or counter-roller of the press. In such a case the advantage is obtained that both the hot stamping foil and the article are deformed to a lesser extent and thus obtaining a perfect decoration is facilitated.

Apparatus for carrying out the described method is characterized in that it comprises a matrix formed by a plate with perforations reproducing the decorative design to be made on the surface of the article to be decorated, a hot stamping foil known per se and one or two patrixes adapted to penetrate the perforations of the matrix.

The invention will be better understood from the following detailed description, given merely as an example and therefore not in a limiting sense, of some embodiments thereof, with reference to the accompanying drawings in which.

Figure 1:
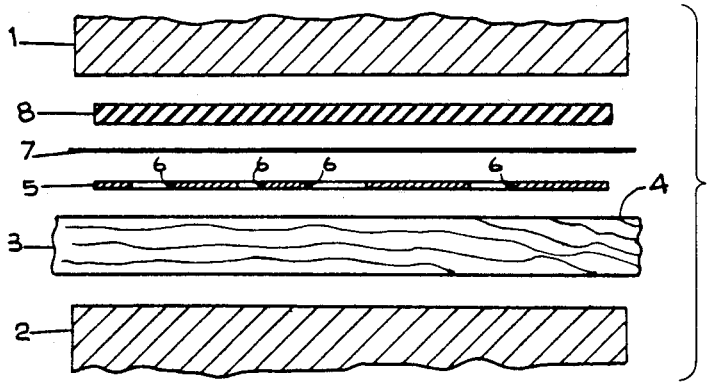
FIG. 1 is an exploded vertical cross-section view depicting the component parts of the apparatus according to the invention which are disposed together with a stiff article to be decorated between the two planes of a vertical hot stamping press.
Figure 2:
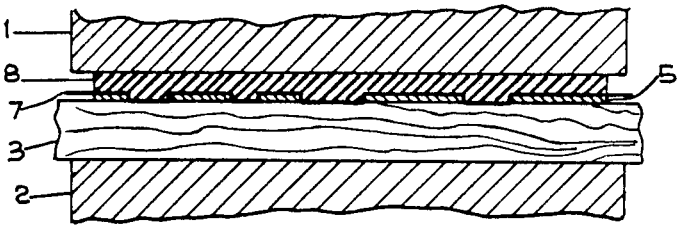
FIG. 2 is a cross-section view similar to that of FIG. 1 in which, however, the press is depicted in an operative condition.
Figure 5:
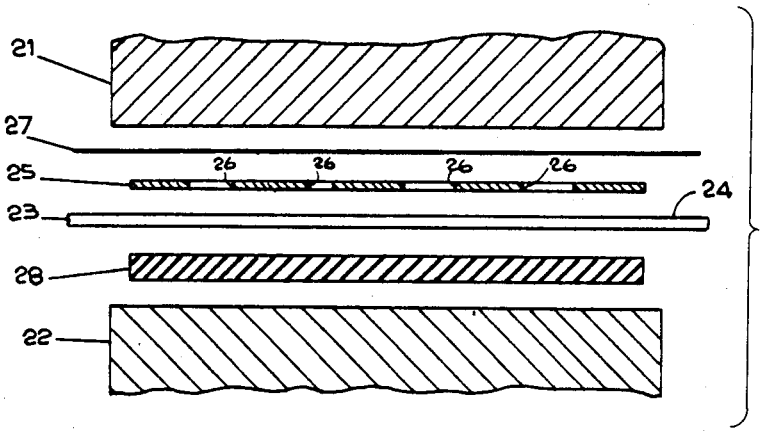
Figure 6:
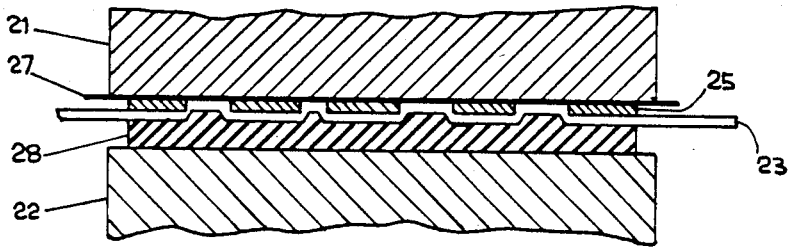
Figure 7:
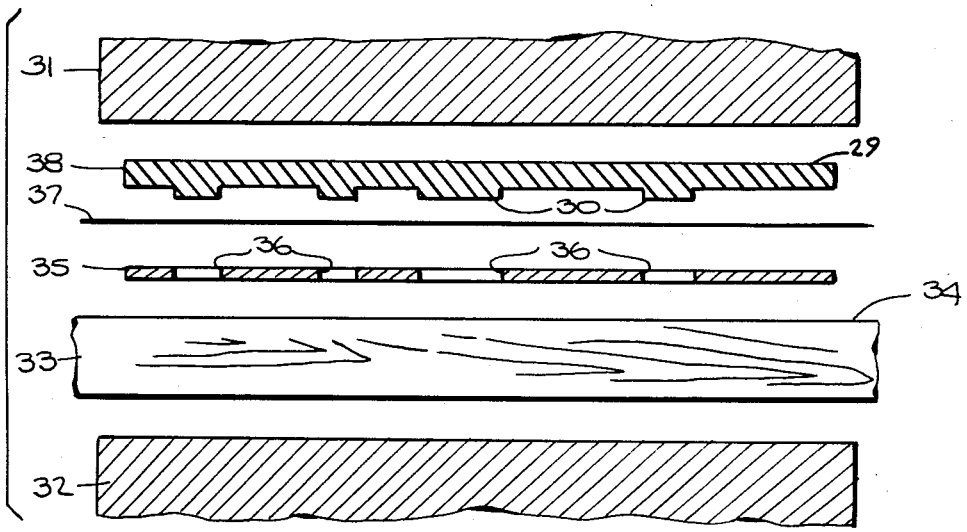
Figure 8:
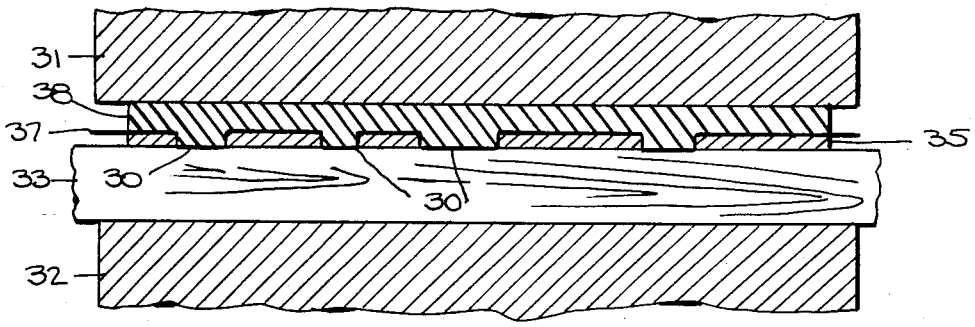

FIGS. 5 and 6 are cross-section views similar to those of FIGS. 1 and 2, with the difference that the article to be decorated in deformable, with the patrix in a position different from that of FIGS. 1 and 2 and;

FIGS. 7 and 8 are cross-section views similar to those of FIGS. 1 and 2, with the difference that the patrix has raised areas which penetrate the perforations in the matrix.

Referring to FIG. 1 it is seen that disposed between the mobile hot plane stamping member 1 and the lower stationery plane stamping member 2 of a vertical hot stamping press are, in sequence, from bottom to top: an article 3 of stiff material, for example a wooden article, whose top surface 4 is to be decorated; the matrix 5 having perforations 6 reproducing the decorative design to be made on the surface 4 of the article 3, said matrix 5 being for example of metal, plastic, paper, cardboard, fabric, compressed particle materials and the like, according to the type of article to be decorated; the hot stamping foil 7 of a type well known to those skilled in the art, consisting of a backing layer, a stripping layer, a colored layer and a thermoadhesive layer, the facing the surface 4 of the article 3 to be decorated; and a patrix 8 formed by a plate of resilient deformable material, for example rubber, and having a suitable thickness.

When the press is actuated the upper hot plane 1 is lowered and the condition is reached which is shown in FIG. 2. It is seen that the patrix 8 becomes deformed and pushes the foil 7 into the perforations 6 of the matrix 5 and causes said foil 7 to adhere to the portion of the surface of the article 3 to be decorated left free by the perforations 6 of the matrix 5. Under action of the heat and pressure, the colored layer of the foil 7 remains permanently applied on the surface 4 of the article to be decorated.

Figure 3:
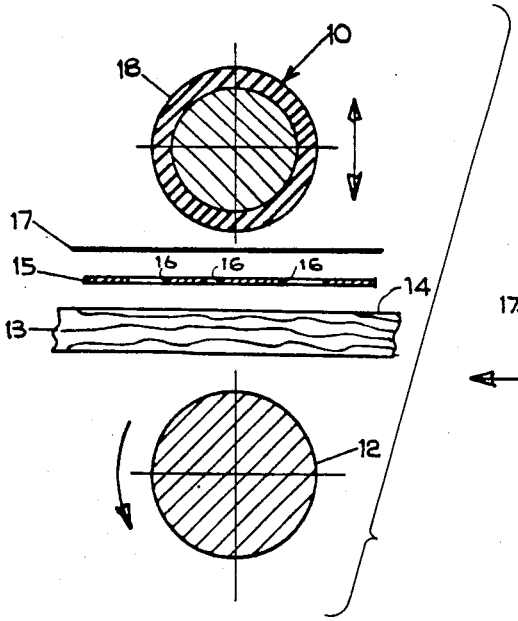
FIG. 3 is a cross-section view similar to that of FIG. 1 in which the press is of the hot roller type.
Figure 4:
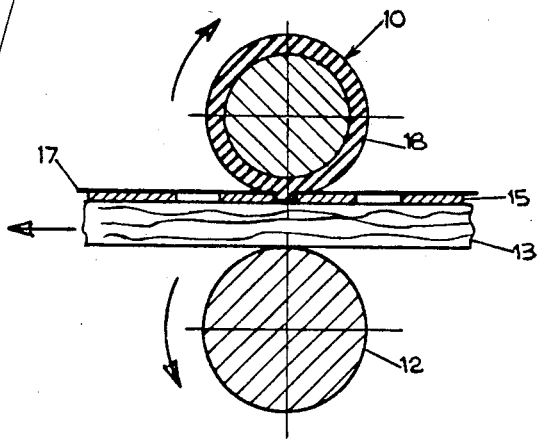
FIG. 4 is a cross-section view similar to that of FIG. 3 in which the press is depicted in an operative condition.

FIGS. 3 and 4 illustrate the case in which a hot roller press is used instead of a vertical hot stamping press. In FIGS. 3 and 4, the upper hot roller 10 which is movable in a vertical direction is coated with a layer 18, for example rubber, which is the equivalent of the patrix 8 of FIGS. 1 and 2. It is apparent that the same results could be achieved also by using a plate shaped patrix as in the case of FIGS. 1 and 2. The related position of the other elements of the fixture and the article to be decorated is the same as in FIGS. 1 and 2. In FIGS. 3 and 4 it is seen that disposed beneath the article 3 to be decorated is a rotatable, powered counter-roller 12 which causes the assembly consisting of the article 13 to be decorated, the matrix 15 and the foil 17 to advance during the operation of the press (FIG. 4).

The method of stamping using the roller press is evident from FIGS. 3 and 4 and the above description.

As is apparent to those skilled in the art, the counter-roller 12 can be substituted by a stiff horizontal plane moving horizontally or by a conveyor belt with a counter-roller. In the latter case, if the conveyor belt is formed of a resilient material of suitable thickness, the same conveyor belt can also perform the function of a patrix.

In FIGS. 5 and 6 there is shown the situation in which the article to be decorated is deformable per se, for example fabrics, felts and hides, or in which the article becomes deformable with heat, for example some plastics, paper, cardboard, lacquers and thin wooden foils.

It is apparent that also with these materials the method described in connection with FIGS. 1 and 2 could be applied as well. However, when utilizing the method described below, it is possible to obtain, in addition to the decoration of the surface of the article, as described above, also raised decorated areas. To obtain an article with raised decorated areas, it is sufficient to dispose between the two planes of a vertical hot plane press in sequence, from bottom to top (FIG. 5); the patrix 28; the article 23 to be decorated; the matrix 25 with its perforations 26; and the hot stamping foil 27. In this case it is not the foil 27 which is deformed and pushed into the perforations 26, but it is the article 23 itself which is deformed and pushed into the perforations 26 of the matrix 25 and causes the portion of the article surface 24 to be decorated to adhere to the surface of the foil in the area of the perforations 26 and this due to the deformation of the patrix 28 (FIG. 6). If the article 23 to be decorated is made of a type of material adapted to maintain the deformation it has undergone, a raised decoration will result.

It is also apparent that the same results can be achieved by using a hot roller press of the type described above instead of a vertical hot plane press. Also in the latter case the patrix can consist of a coating of the counter-roller of the press or of the conveyor belt of resilient material, for instance rubber.

In the preceding description reference is made exclusively to a patrix consisting of a plate of deformable resilient material. Referring to FIGS. 7 and 8, the patrix 38 could, however, consist also of a plate 29 of any elastically non deformable material, for instance metal, cardboard, plastic, etc., and carry raised areas 30 corresponding to the perforations 36 of the matrix 35 which can penetrate the perforations and push into them the hot stamping foil to contact the surface 34 of the article 33 to be decorated.

These raised portions can be of the same material as the plate and can if necessary, be integral with the plate, or they can be of a different material and be applied on the plate. For example, the raised areas can be made of epoxy resins or silicone rubber.

As is apparent from the preceding description the invention provides a new method of stamping decorations on articles by means of a hot stamping press which completely differs from the prior art methods of stamping by means of a printing plate, and has considerable advantages with over the prior art methods.

It should be noted first that in the case of stamping by means of a printing plate it is essential that the raised area be as high as possible (at least 1 mm), otherwise the printing plate could also stamp non-raised areas and an inaccurate stamping would be obtained.

Instead, according to the present invention, optimally, the matrix should have the minimum possible thickness (for example 0.1 mm).

Secondly, the printing plate must be made of as hard a material as possible, for example steel, so that its raised areas last for a long time without deformation, thus permitting the same printing plate to effect a large number of stampings.

By using instead the matrix according to the present invention, the stamped raised areas either obtained by a deformation of a resilient deformable patrix or carried by a not necessarily deformable patrix, must be as soft as possible.

The cost of a steel printing plate is, as an order of magnitude, about 100 lines that of a matrix-patrix assembly according to the present invention.

In addition, the printing plates, if they are of large size, for example a 300 mm × 500 mm size, do not stamp in a uniform manner because at one spot the printing plate, if of steel, penetrates too deeply in the article to be decorated or, if of silicone rubber, it expands under the pressure of the press and, in another spot the stamping plate, whether of steel or silicone rubber, does not contact the surface of the article sufficiently to sharply stamp it.

It is therefore shown that by means of the method according to the invention a sharper and a much more inexpensive stamping of decorations on articles is obtained.

Where two patrixes are used, one is disposed between the hot plane or roller of the press and the hot stamping foil and the other between the deformable article to be decorated and the associated maxtrixes with their perforations.

It is, however, possible to obtain decorations in different colors in a single operation by using a matrix and two or more foils having different colors which cover different areas of the matrix including different perforations.

The use of hot stamping foils has the advantage with respect to other coloring methods such as gun sprying or brushing or silk-screen printing, that decorations can be obtained with highly brilliant effects, in gold, silver, marble, briarwood effects, many wood designs, etc., not possible with the other above mentioned methods. These effects are obtainable because hot stamping foils are available which incorporate and transfer these effects to the article to be decorated a signal operation.

While only some embodiments of the method and fixture according to the invention have been illustrated and described, it is obvious that a number of modifications and changes can be made without departing from the scope of the invention.

I claim:

1. A method of stamping decorations on articles of various types by means of a hot stamping press having opposed stamping members comprising the steps of placing the article to be decorated between the stamping members, placing in contact with the surface of the article to be decorated a matrix having perforations reproducing the decorative design to be made on the surface of the article to be decorated, placing on the surface of the matrix opposite that in contact with the article a hot stamping foil having an adhesive layer with the adhesive layer facing the matrix, placing a patrix adapted to penetrate the perforations of the matrix between the hot stamping foil and one of the stamping members of the hot stamping press and operating the hot stamping press to cause the patrix to penetrate the perforations of the matrix to force the hot stamping foil through the perforations of the matrix into contact with the surface of the article to be decorated.

2. Apparatus for stamping decorations on articles of various types by means of a hot stamping press having opposed stamping members, the apparatus adapted to be placed between the stamping members of the stamping press and comprising a matrix having perforations reproducing the decorative design to be made on the surface of the article to be decorated, a patrix adapted to penetrate the perforations of the matrix and a hot stamping foil, the apparatus being disposed with the patrix in contact with one stamping member of the stamping press, the matrix in contact with the article surface to be decorated, the hot stamping foil between the matrix and the patrix, the surface of the article opposite the surface to be decorated in contact with the other stamping member such that the stamping members of the hot stamping press force the patrix and with it portions of the hot stamping foil to penetrate the perforations of the matrix and contact the surface of the article to be decorated.

3. Apparatus as claimed in claim 2 wherein the patrix consists of a plate of resilient deformable material adapted to penetrate the perforations of the matrix by elastic deformation of the resilient deformable material.

4. Apparatus as claimed 2 wherein the patrix consists of a plate carrying raised areas corresponding to the perforations of the matrix so as to penetrate them.

5. Apparatus as claimed 4 wherein the raised areas are of the same material as the patrix plate and are integral therewith.

6. Apparatus as claimed in claim 4 wherein the raised areas are secured to but not integral with the patrix plate.

7. Apparatus as claimed in claim 6 wherein the raised areas are of the same material as the patrix plate.

8. Apparatus as claimed in claim 6 wherein the raised areas are of a material different from that of the patrix plate.

9. Apparatus as claimed in claim 2 wherein the apparatus is adapted to be used with a hot stamping press of the hot roller type which includes a hot roller, and wherein the patrix consists of a coating on the hot roller.

* * * * *